US008118246B2

(12) United States Patent
Yamaguchi et al.

(10) Patent No.: US 8,118,246 B2
(45) Date of Patent: Feb. 21, 2012

(54) MOBILE CRUSHER

(75) Inventors: Masaho Yamaguchi, Kyotanabe (JP); Yasutaka Nishida, Hirakata (JP); Mitsunobu Yamada, Hirakata (JP); Tooru Nakayama, Hirakata (JP); Ryouichi Togashi, Tokyo (JP)

(73) Assignee: Komatsu Ltd., Tokyo (JP)

( * ) Notice: Subject to any disclaimer, the term of this patent is extended or adjusted under 35 U.S.C. 154(b) by 275 days.

(21) Appl. No.: 12/472,543

(22) Filed: May 27, 2009

(65) Prior Publication Data

US 2009/0294560 A1 Dec. 3, 2009

(30) Foreign Application Priority Data

May 28, 2008 (JP) ..... 2008-139467
Mar. 27, 2009 (JP) ..... 2009-078912

(51) Int. Cl.
*B02C 4/32* (2006.01)
*B02C 7/14* (2006.01)

(52) U.S. Cl. ..... 241/36; 241/101.74; 241/101.741

(58) Field of Classification Search ..... 241/101.74, 241/101.741, 36

See application file for complete search history.

(56) References Cited

U.S. PATENT DOCUMENTS 4,272,032 A 6/1981 Hellberg
4,934,611 A * 6/1990 Lewis ..... 241/36
6,354,524 B1 3/2002 Nakayama et al.
6,588,691 B2 7/2003 Yamamoto et al.
6,811,300 B2 11/2004 Kamoshida et al.
7,124,971 B2 10/2006 Sugimura et al.
7,806,353 B2 * 10/2010 Douglas et al. ..... 241/101.74
2004/0129815 A1 * 7/2004 Togashi et al. ..... 241/268
2004/0155128 A1 * 8/2004 Ikegami et al. ..... 241/36
2004/0200914 A1 * 10/2004 Hishiyama et al. ..... 241/101.74
2005/0061900 A1 3/2005 Okuya
2006/0097095 A1 5/2006 Boast
2006/0144974 A1 * 7/2006 Umeda et al. ..... 241/30
2006/0202075 A1 9/2006 Young et al.
2008/0116307 A1 5/2008 Young et al.

(Continued)

FOREIGN PATENT DOCUMENTS

JP 5-184968 A 7/1993

(Continued)

OTHER PUBLICATIONS

Yamaguchi et al., "Self-Traveling Crusher", U.S. Appl. No. 12/464,247, filed May 12, 2009.

*Primary Examiner* — Bena Miller
(74) *Attorney, Agent, or Firm* — Holtz, Holtz, Goodman & Chick, PC

(57) ABSTRACT

A mobile crusher includes: a crusher for crushing raw materials; a discharge conveyor provided on a lower stream of the crusher for discharging the raw materials crushed by the crusher; a work implement provided on an upper stream of the crusher for producing the crushed materials; a conveyor sensor and conveyor pressure comparing unit for determining whether the crushed materials to be discharged are fed on the discharge conveyor or not; a crusher pressure sensor and crusher pressure comparing unit for determining whether the raw materials are present in the crusher or not; and a flow rate controller for controlling the speeds of the crusher, discharge conveyor and work implement based on determination results of the conveyor pressure sensor, conveyor pressure comparing unit, crusher pressure sensor and crusher pressure comparing unit.

13 Claims, 4 Drawing Sheets

U.S. PATENT DOCUMENTS

2009/0302141 A1 12/2009 Yamaguchi et al.

FOREIGN PATENT DOCUMENTS

| | | | |
|---|---|---|---|
| JP | 11-10023 | A | 1/1999 |
| JP | 11-226446 | A | 8/1999 |
| JP | 2000-136739 | A | 5/2000 |
| JP | 2000-317339 | A | 11/2000 |
| JP | 2004-73957 | A | 3/2004 |
| JP | 2004-108251 | A | 7/2004 |
| JP | 2005-270847 | A | 10/2005 |
| JP | 2007-50383 | A | 3/2007 |
| JP | 2007-245035 | A | 9/2007 |

* cited by examiner

MOBILE CRUSHER

BACKGROUND OF THE INVENTION

1. Field of the Invention

The present invention relates to a mobile crusher.

2. Description of Related Art

A mobile crusher including a crusher that crushes raw materials has been typically known. In such a mobile crusher, raw materials conveyed by a feeder are crushed to a predetermined size by the crusher to be discharged by a discharge conveyor. When a detector for detecting the raw materials on the feeder and crusher detects an idling of the feeder or crusher (the idling means that a work implement is operated without raw materials or crushed materials), a controller slows engine speed down to idling rotational speed during the idling, thereby reducing fuel consumption (Document 1: JP-A-2000-136739). Alternatively, a controller may control fuel injection quantity depending on the weight of raw materials mounted on the feeder irrespective of the presence of the raw materials within the crusher (Document 2: JP-A-5-184968).

However, in the mobile crusher as disclosed in Document 1, only the engine speed is controlled and the speed of the work implement is not controlled. Thus, a deceleration rate of the work implement speed during the idling is the same as a deceleration rate of the engine speed. Since the engine idling rotational speed is approximately 50% of normal speed, the work implement speed is decelerated by approximately 50%. However, approximately 50% deceleration of the work implement speed is not sufficient for power reduction.

In the mobile crusher as disclosed in Document 2, engine output is decreased when the weight of the raw materials mounted on the feeder is reduced even while the raw materials are crushed by the crusher. Thus, an operation quantity of the crusher is reduced and therefore crushing efficiency is reduced.

SUMMARY OF THE INVENTION

An object of the invention is to provide a mobile crusher capable of decelerating a work implement after reliably discharging crushed materials, and restarting the work implement smoothly so that reduction in working efficiency can be prevented.

A mobile crusher according to an aspect of the invention includes: a crusher that crushes raw materials; a discharge conveyor provided on a lower stream of the crusher to discharge the raw materials crushed by the crusher; a work implement provided on an upper stream of the crusher to produce crushed materials; a crushed material determining unit that determines a presence or absence of the crushed materials to be discharged on the discharge conveyor; a raw material determining unit that determines a presence or absence of the raw materials in the crusher; a work implement speed controller that controls speeds of the crusher, discharge conveyor and work implement based on determination results of the crushed material determining unit and the raw material determining unit.

A mobile crusher according to another aspect of the invention includes: a crusher that crushes raw materials; a discharge conveyor provided on a lower stream of the crusher to discharge the raw materials crushed by the crusher; a work implement provided on an upper stream of the crusher to produce crushed materials; a crushed material determining unit that determines a presence or absence of the crushed materials to be discharged on the discharge conveyor; a work implement speed controller that controls speeds of the crusher, discharge conveyor and work implement based on a determination result of the crushed material determining unit.

A mobile crusher according to still another aspect of the invention includes: a crusher that crushes raw materials; a discharge conveyor provided on a lower stream of the crusher to discharge the raw materials crushed by the crusher; a work implement provided on an upper stream of the crusher to produce the crushed materials; an engine that activates the crusher, discharge conveyor and work implement; and an engine controller that decelerates an engine speed to a decelerated speed when determining that no load is applied on the crusher, the mobile crusher comprising: hydraulic motors that drive the crusher, discharge conveyor and work implement, respectively; a hydraulic pump driven by the engine to supply hydraulic oil to the hydraulic motors and drive the hydraulic motors; and a work implement speed controller that decelerates speeds of the crusher, discharge conveyor and work implement and reduces a discharge flow rate of the hydraulic pump and rotational speeds of the hydraulic motors so that a deceleration rate of the work implement is larger than a deceleration rate of the crusher when the engine controller decelerates the engine speed to the decelerated speed.

In the above-described arrangements, the mobile crusher includes the crusher, discharge conveyor, and work implement controller that controls the drive of the work implement depending on the presence or absence of the crushed materials, that is to say, the presence or absence of the load. When no load is applied, the crusher, discharge conveyor and work implement are decelerated. Thus, fuel consumption can be reduced.

DETAILED DESCRIPTION OF PREFERRED EMBODIMENT(S)

Exemplary embodiment(s) of the invention will be described below with reference to the attached drawings.

Figure 1:
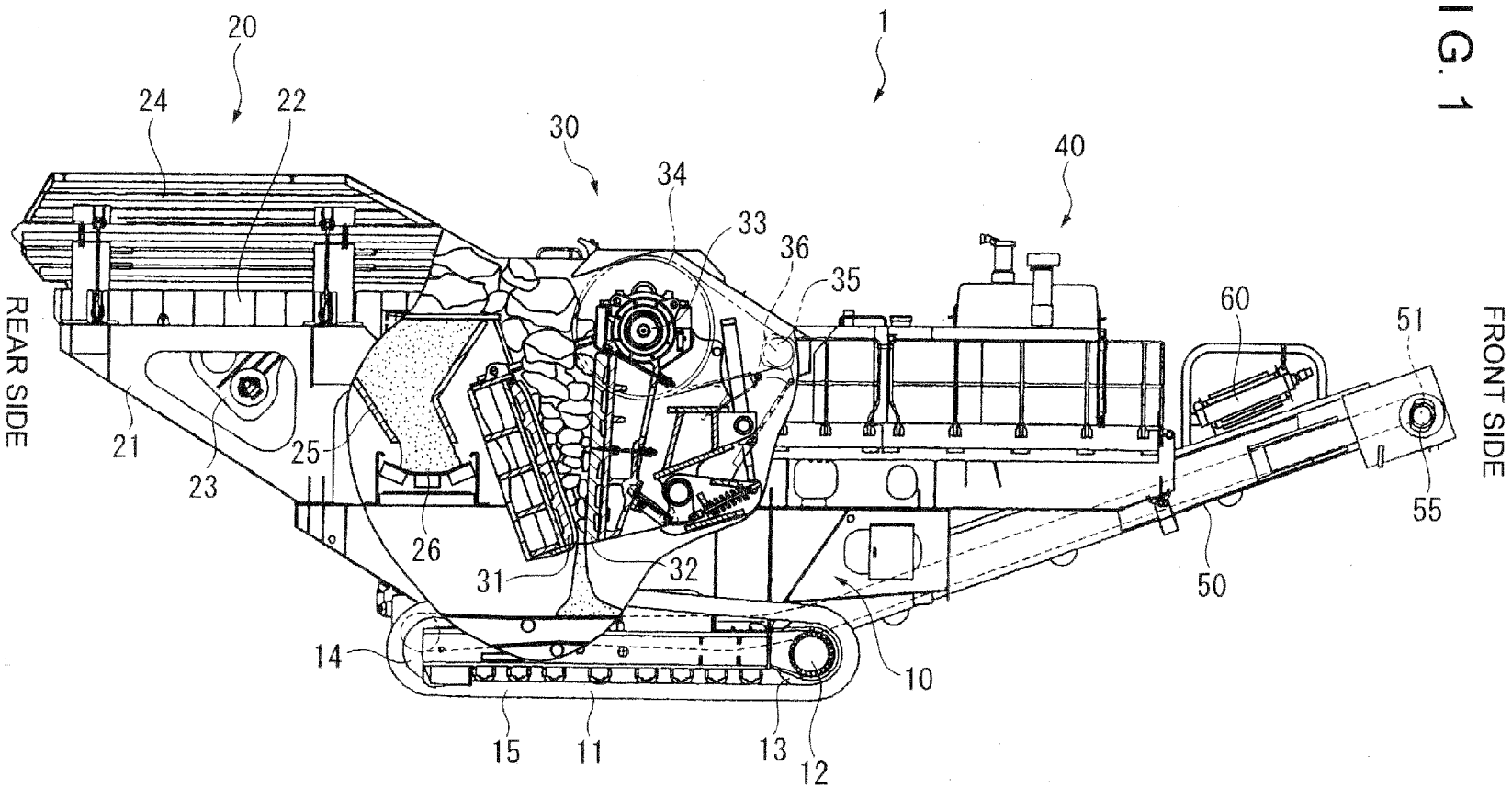
FIG. 1 is a side view of a mobile crusher according to an exemplary embodiment of the invention.

FIG. 1 is a side view showing a mobile crusher 1 according to the exemplary embodiment. The mobile crusher 1 crushes raw materials loaded by a loader such as a hydraulic excavator and a wheel loader to produce crushed materials having a predetermined particle size.

The mobile crusher 1 includes: a main unit 10 having a pair of undercarriage members 11 (one of which is shown); a feed unit 20 that is provided to the rear side on top of the main unit 10 (on the left side in FIG. 1) for supplying raw materials; a crusher 30 provided to the front side of the feed unit 20 (on the right side in FIG. 1); a power unit 40 provided to the front side of the crusher 30; a discharge conveyor 50 extending forward and obliquely upward between a pair of crawlers 15 on a lower portion of the main unit 10; and a controller 70 for controlling the discharge conveyor 50 and other work implements.

The main unit 10 includes the undercarriage members 11 on the lower portion. The undercarriage members 11 each include the crawler 15 that is wound around a front sprocket wheel 13 driven by a hydraulic motor 12 and a rear idler tumbler 14.

In the feed unit 20, a grizzly feeder 22 (feeder serving as a work implement) is mounted via a plurality of springs (not shown) on the upper side of right and left side frames 21 protruding rearward. The grizzly feeder 22 is driven by a vibrator 23. A hopper 24 is provided on the upper side of the grizzly feeder 22, covering the grizzly feeder 22 from its three sides. Raw materials are thrown into the hopper 24 of which an opening widens upward. A muck shooter 25 is provided on the lower side of the grizzly feeder 22. The muck shooter 25 delivers to a muck conveyor 26 (work implement) uncrushed materials dropped into the muck shooter 25 after being selected by the grizzly feeder 22.

The crusher 30 is a jaw crusher including a fixed jaw 31 and a swing jaw 32. When a pulley 34 provided on an end of a main shaft 33 is driven by a hydraulic motor 35 via a V-belt, the swing jaw 32 functions as a swinging link by the rotation of the main shaft 33 to crush the raw materials between the fixed jaw 31 and the swing jaw 32. The hydraulic motor 35 of the crusher 30 is provided with a crusher pressure sensor 36 serving as a raw material determining unit for measuring a load pressure value $P_3$. When the raw materials are crushed by the crusher 30, the crusher pressure sensor 36 detects the load pressure value $P_3$ of the hydraulic motor 35 and outputs an electrical signal. The load pressure value $P_3$ is varied depending on the amount of the raw materials thrown into the crusher 30.

Because whether the raw materials are thrown or not is determined in the crusher 30, the hydraulic motor 35 of the crusher 30 needs to be constantly operated at low speed even when the raw materials are not present within the crusher 30. Accordingly, the grizzly feeder 22 for feeding the raw materials to the crusher 30 needs to be also operated at low speed. Thus, the grizzly feeder 22 and crusher 30 cannot be stopped.

Figure 2:
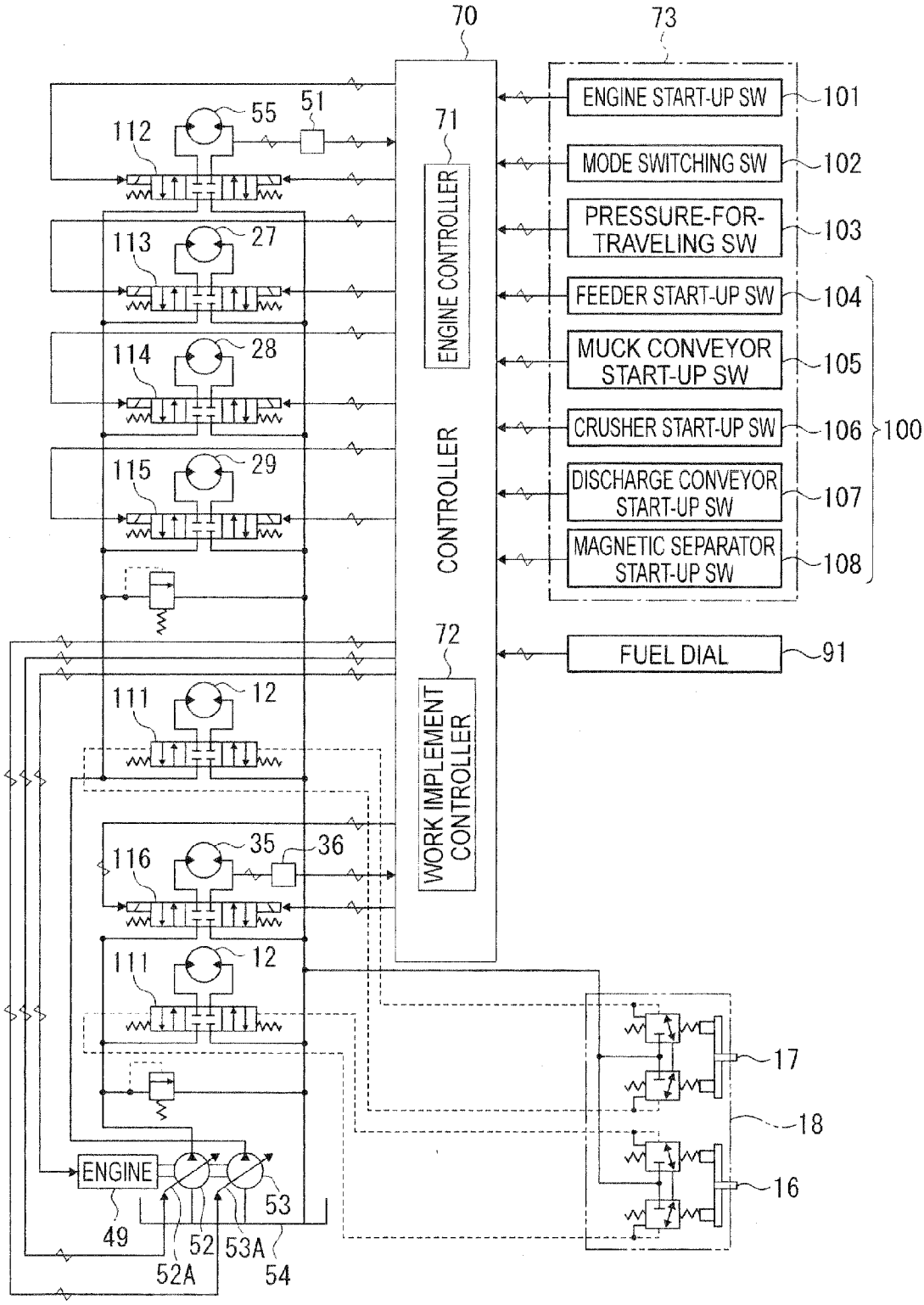
FIG. 2 shows a hydraulic circuit according to the exemplary embodiment.

Referring to a hydraulic circuit of the mobile crusher 1 as shown in FIG. 2, the power unit 40 includes an engine 49, variable displacement hydraulic pumps 52 and 53 driven by the engine 49, a fuel tank and a hydraulic oil tank 54. The engine 49 is provided with a fuel injector (not shown) electrically connected to a controller 70. A fuel injection signal based on a set signal of an engine speed set by a fuel dial 91 is outputted from the controller 70 to the fuel injector (not shown), so that the engine 49 is driven. In an operation mode according to this exemplary embodiment, an engine speed $\omega$, which is the engine speed set by the fuel dial 91 depending on the presence or absence of the raw materials and crushed materials on the grizzly feeder 22, muck conveyor 26, crusher 30, discharge conveyor 50 and magnetic separator 60, is controlled to be slowed down to a decelerated speed $\omega_0$ (hereinafter referred to as auto deceleration control). Normally, the decelerated speed $\omega_0$ is approximately 50% of the engine speed $\omega$ (normal speed) set by the fuel dial 91. The invention is effectively usable with the auto deceleration control. However, in this exemplary embodiment, it is assumed that the decelerated speed $\omega_0$ is the same as the normal speed $\omega$ for facilitating understanding.

Hydraulic pressure from the hydraulic pump 52 is supplied to the hydraulic motor 12 of the undercarriage members 11 and the hydraulic motor 35 of the crusher 30 through control valves 111 and 116 while being supplied to the control valve 111 as pilot pressure through a direction switching device 18 provided on a right travel lever 16.

Hydraulic pressure from the hydraulic pump 53 is supplied to the hydraulic motor 12 of the undercarriage members 11, a hydraulic motor 55 of the discharge conveyor 50, a hydraulic motor 27 of the vibrator 23 provided on the grizzly feeder 22, a hydraulic motor 28 of the magnetic separator 60, and a hydraulic motor 29 of the muck conveyor 26 through the control valves 111 to 115 while being supplied to the control valve 111 as pilot pressure through the direction switching device 18 provided on a left travel lever 17. The pilot pressures of these control valves 111 to 116 are under electromagnetic proportional control, so that flow rates of hydraulic oil supplied to the hydraulic motors 12, 27 to 29, 35 and 55 are controlled.

The discharge conveyor 50 discharges forward and drops from a height crushed materials, which are dropped from the outlet of the crusher 30, to accumulate the dropped crushed materials. When raw materials contain foreign substances such as reinforcing steel bars and metal chips, the magnetic separator 60 may be mounted on the front side of the discharge conveyor 50 to remove the foreign substances. The discharge conveyor 50 is provided with a conveyor pressure sensor 51 serving as a crushed material determining unit for detecting a load pressure value $P_1$ of the hydraulic motor 55. The load pressure value $P_1$ is varied depending on the amount of the crushed materials mounted on the discharge conveyor 50. The grizzly feeder 22 and muck conveyor 26 (work implements) are disposed on an upper stream of the crusher 30 for producing the crushed materials, and the discharge conveyor 50 aid magnetic separator 60 are disposed on a lower stream of the crusher 30.

As shown in FIG. 2, the mobile crusher 1 is provided with an operation panel 73 having operation boards or the like. The operation panel 73 includes an engine start-up SW 101, a mode switching SW 102, a pressure for traveling SW 103 and a group 100 of ON-OFF switches (SWs) of the work implements. The operation panel 73 is electrically connected to the controller 70.

The work implements SW group 100 includes a feeder start-up SW 104, a muck conveyor start-up SW 105, a crusher start-up SW 106, a discharge conveyor start-up SW 107, and a magnetic separator start-up SW 108. Electrical signals from the work implements SW group 100 are inputted to the controller 70.

The crusher pressure sensor 36, the conveyor pressure sensor 51, and the fuel dial 91 for setting a speed of the engine 49 are electrically connected to the controller 70. Signals from the sensors 36 and 51 and the fuel dial 91 are inputted to the controller 70.

Figure 3:
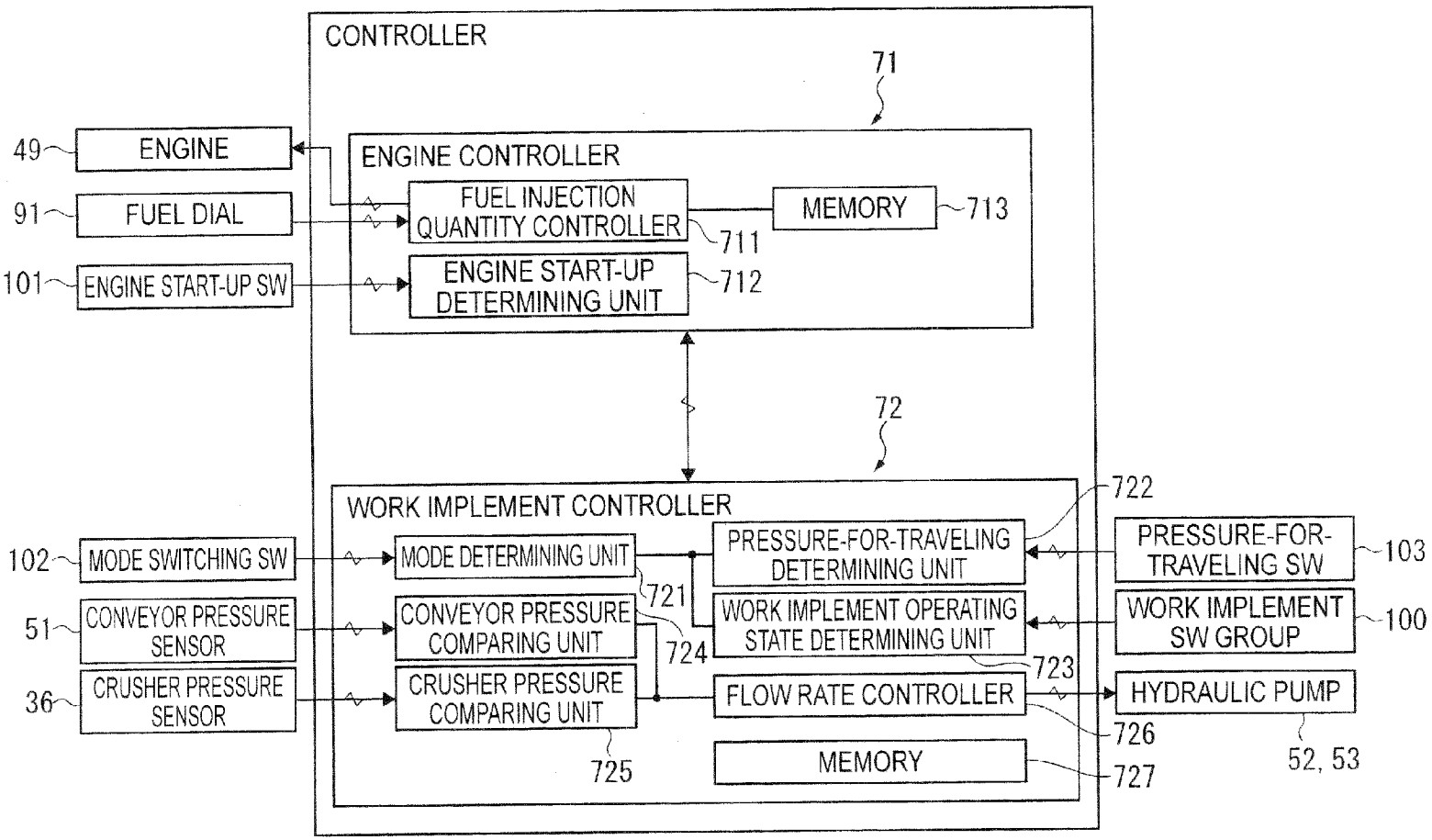
FIG. 3 is a block diagram according to the exemplary embodiment.

Referring to a block diagram of the controller 70 in FIG. 3, the controller 70 is equipped with a CPU (Central Processing Unit). The controller 70 includes an engine controller 71 and a work implement controller 72. The engine controller 71 includes a fuel injection quantity controller 711, an engine start-up determining unit 712, and a memory 713, which are provided by software such as a computer program. The memory 713 stores a decelerated speed $\omega_0$ for driving the engine in a deceleration state (that is to say, a state where the work implements are not operated and the engine speed is slow) while storing the engine speed set by the fuel dial 91.

The work implement controller 72 includes: a mode determining unit 721; a pressure-for-traveling determining unit 722; a work implement operating state determining unit 723; a conveyor pressure comparing unit 724 serving as the raw material determining unit; a crusher pressure comparing unit 725 serving as the crushed material determining unit; a flow rate controller 726 serving as a work implement speed controller for controlling discharge flow rates of the hydraulic pumps 52 and 53 and operations of the control valves 112 to 116; and a memory 727, which are provided by software such as a computer program. The memory 727 stores: a minimum pressure value $P_0$ of the hydraulic motor 55 when the crushed materials are not fed on the discharge conveyor 50; a minimum pressure value $P_2$ of the hydraulic motor 35 when the raw materials are not thrown into the crusher 30; a discharge flow rate Q of the hydraulic pumps 52 and 53 when the crushed materials are not fed on the discharge conveyor 50; and pilot pressures of the control valves 112 to 116 in accordance with predetermined rotational speeds $N_{1L}$, $N_{2L}$, $N_{3L}$, $N_{4L}$ and $N_{5L}$ of the hydraulic motors 27 to 29, 35 and 55 when the crushed materials are not fed on the discharge conveyor 50.

Figure 4:
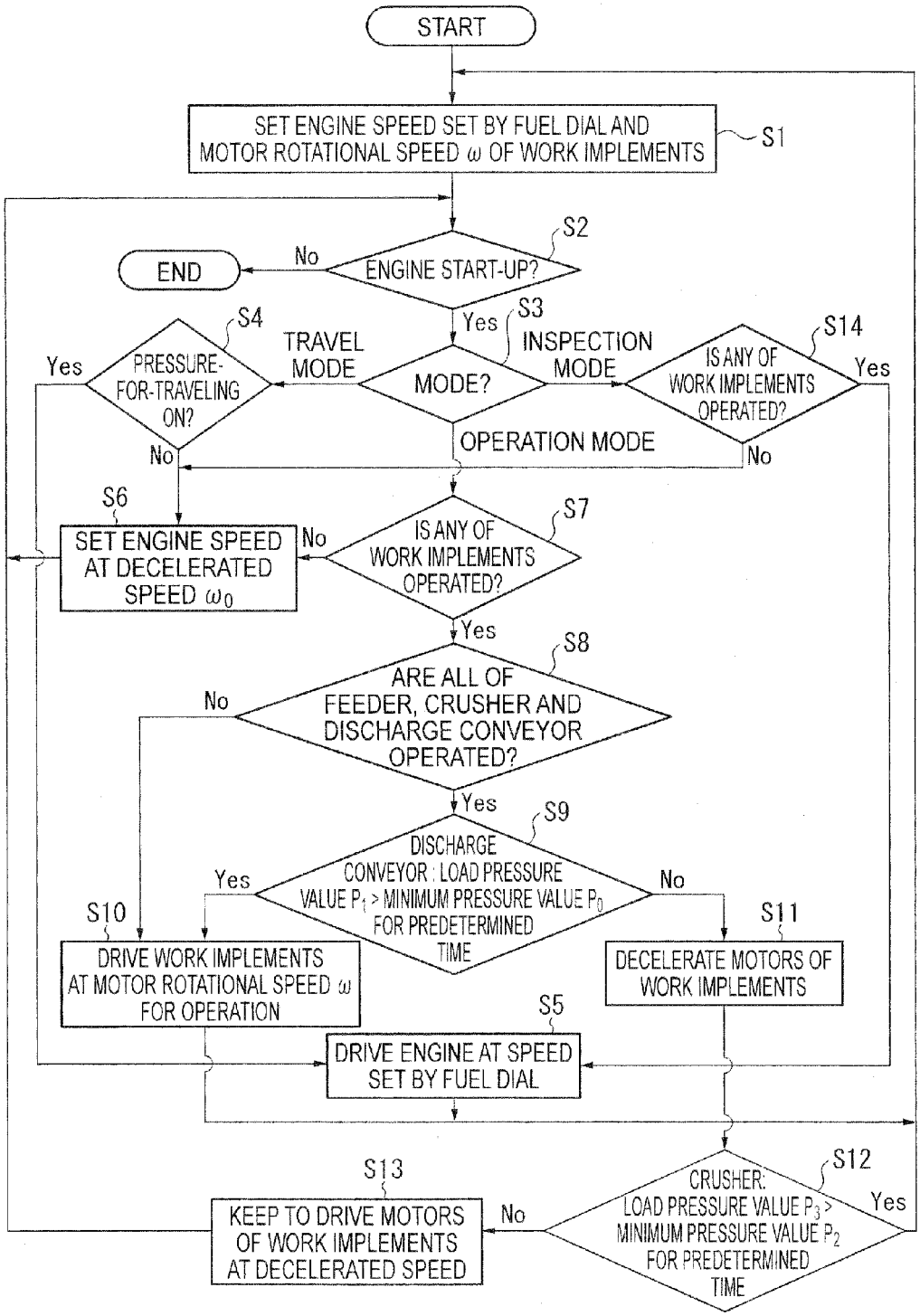
FIG. 4 is a flow chart according to the exemplary embodiment.

Next, functions of the units included in the controllers 71 and 72 will be described below with reference to a flow for controlling the hydraulic motors 27 to 29, 35 and 55 of the grizzly feeder 22, the muck conveyor 26, the crusher 30, the discharge conveyor 50 and the magnetic separator 60 of the mobile crusher 1 depending on the presence or absence of the raw materials and crushed materials as shown in FIG. 4.

An operator initially sets a speed of the engine 49 by the fuel dial 91 and starts up the engine 49 in the operation mode by the engine start-up SW 101 to start up the grizzly feeder 22, muck conveyor 26, crusher 30, discharge conveyor 50 and magnetic separator 60.

The rotational speed set by the fuel dial 91 is stored in the memory 713 and inputted to the fuel injection quantity controller 711 to be set as a desired engine speed ω. At the same time, motor rotational speeds $N_1$, $N_2$, $N_3$, $N_4$ and $N_5$ of the hydraulic motors 27 to 29, 35 and 55, which are required for normal crushing operation in the operation mode, are set in the flow rate controller 726 (S1). Subsequently, the flow rate controller 726 determines discharge flow rates of the hydraulic pumps 52 and 53 depending on the motor rotational speeds and engine speed, and controls an angle (inclination angle) of swash plates 52A and 53A to drive the hydraulic motors 27 to 29, 35 and 55 of the grizzly feeder 22, muck conveyor 26, crusher 30, discharge conveyor 50 and magnetic separator 60 at the motor rotational speeds $N_1$, $N_2$, $N_3$, $N_4$ and $N_5$.

Then, the engine start-up determining unit 712 determines whether the engine start-up SW 101 is ON or OFF. When the engine start-up SW 101 is ON, the engine start-up determining unit 712 outputs a start-up signal to the mode determining unit 721 of the work implement controller 72 (S2).

Upon receiving the start-up signal from the engine start-up determining unit 712, the mode determining unit 721 determines which one of a travel mode, operation mode and inspection mode the mode switching SW 102 is positioned at, and then outputs a signal corresponding to the determined mode. More specifically, the mode determining unit 721 outputs a travel-mode signal to the pressure-for-traveling determining unit 722 when determining that the mode switching SW 102 is positioned at the travel mode. Also, the mode determining unit 721 outputs an operation-mode signal or inspection-mode signal to the work implement operating state determining unit 723 when determining that the mode switching SW 102 is positioned at the operation mode or inspection mode (S3). Next, a flow corresponding to each mode will be described.

Travel Mode

Upon receiving the travel-mode signal from the mode determining unit 721, the pressure-for-traveling determining unit 722 determines whether a signal indicating at least one of a left forward travel, left rearward travel, right forward travel and right rearward travel is inputted by the pressure for traveling SW 103 or not, and then outputs to the fuel injection quantity controller 711 of the engine controller 71 a travel-determination signal corresponding to a travel pattern (S4).

Upon receiving the travel-determination signal indicating any of the above-described travel patterns, the fuel injection quantity controller 711 reads a set value of the engine speed set by the fuel dial 91 and determines a fuel injection quantity to be injected to the engine 49 so as to drive the engine 49 (S5). Then, the above-described steps S1 to S5 are repeated. Upon receiving the travel-determination signal indicating that no travel is performed in S4, the fuel injection quantity controller 711 reads a decelerated speed $\omega_0$ from the memory 713 to control a fuel injection quantity to be injected to the engine 49 (S6). Then, the above-described steps S2 to S4 and S6 are repeated.

Operation Mode

Upon receiving the operation-mode signal from the mode determining unit 721, the work implement operating state determining unit 723 of the work implement controller 72 executes the above-described auto deceleration control. In the exemplary embodiment, the normal speed ω of the engine is the same as the decelerated speed $\omega_0$ for facilitating understanding. Then, the work implement operating state determining unit 723 determines whether the feeder start-up SW 104, muck conveyor start-up SW 105, crusher start-up SW 106, discharge conveyor start-up SW 107 and magnetic separator start-up SW 108 are ON or OFF (S7). When none of the grizzly feeder 22, muck conveyor 26, crusher 30, discharge conveyor 50, and magnetic separator 60 are operated, the work implement operating state determining unit 723 outputs a non-operation signal to the fuel injection quantity controller 711 of the engine controller 71 (S7). Upon receiving the non-operation signal, the fuel injection quantity controller 711 reads a decelerated speed $\omega_0$ from the memory 713 to control a fuel injection quantity for injecting fuel to the engine 49 depending on the decelerated speed $\omega_0$. At this time, the fuel injection quantity is usually reduced. However, in this exemplary embodiment, the fuel injection quantity is not varied because of the above-described reason.

When at least any one of the grizzly feeder 22, muck conveyor 26, crusher 30, discharge conveyor 50 and magnetic separator 60 is determined to be in operation, the work implement operating state determining unit 723 determines which of the grizzly feeder 22, muck conveyor 26, crusher 30, discharge conveyor 50 and magnetic separator 60 is operated. When determining that all of the grizzly feeder 22, muck conveyor 26, crusher 30, discharge conveyor 50 and magnetic separator 60 are operated, the work implement operating state determining unit 723 outputs an all-operation signal to the conveyor pressure comparing unit 724. Otherwise, the work implement operating state determining unit 723 outputs a part-operation signal to the fuel injection quantity controller 711 of the engine controller 71 (S8). When all of the grizzly feeder 22, crusher 30 and discharge conveyor 50 are operated, the mobile crusher is operable for crushing. When one or more of the grizzly feeder 22, crusher 30 and discharge conveyor 50 is not operated, the mobile crusher is not operable for crushing.

Upon receiving the all-operation signal, the conveyor pressure comparing unit 724 repeatedly monitors for a predetermined time a load pressure value $P_1$ of the hydraulic motor 55 of the discharge conveyor 50 using the conveyor pressure sensor 51 so as to compare the load pressure value $P_1$ with the minimum pressure value $P_0$ stored in the memory 727 (S9). The "predetermined time" as described above is longer than a series of operation time for dropping raw materials into the hopper 24, crushing the raw materials in the crusher 30 and discharging the crushed materials from the discharge conveyor 50. The same applies in the following description. When the conveyor pressure comparing unit 724 determines that the load pressure value $P_1$ is larger than the minimum pressure value $P_0$, the crushed materials are fed on the discharge conveyor 50. Therefore, the fuel injection quantity controller 711 of the engine controller 71 drives the engine 49 at the engine speed set by the fuel dial 91 and drives the hydraulic motors 27 to 29, 35 and 55 at the motor rotational speeds $N_1$, $N_2$, $N_3$, $N_4$ and $N_5$ (S10). Then, the above-described steps S1 to S3 and S7 to S10 are repeated.

Conversely, when the conveyor pressure comparing unit 724 determines that the load pressure value $P_1$ is smaller than the minimum pressure value $P_0$ in S9, none of the crushed materials are fed on the discharge conveyor 50. Therefore, the flow rate controller 726 read a discharge flow rate Q of the hydraulic pumps 52 and 53 from the memory 727 and changes an angle of the swash plates 52A and 53A to decelerate the motor rotational speeds of the hydraulic motors 27 to 29, 35 and 55 of the grizzly feeder 22, muck conveyor 26, crusher 30, discharge conveyor 50 and magnetic separator 60 to $N_{1M}$, $N_{2M}$, $N_{3M}$, $N_{4M}$ and $N_{5M}$ that are lower than the normal speeds $N_1$, $N_2$, $N_3$, $N_4$ and $N_5$ (S11). Thus, a load applied on the hydraulic pumps 52 and 53 is decreased, so that fuel consumption can be reduced.

The flow rate controller 726 in a further read pilot pressures of the control valves 112 to 116 from the memory 727 and control the control valves so that the motor rotational speeds of the hydraulic motors 27 to 29, 35 and 55 become $N_{1L}$, $N_{2L}$, $N_{3L}$, $N_{4L}$ and $N_{5L}$. Preferably, $N_{4L}$ and $N_{4M}$ of the rotational speed of the hydraulic motor 35 of the discharge conveyor 50 are the same, and $N_5$ and $N_{5M}$ of the rotational speed of the hydraulic motor 55 of the magnetic separator 60 are the same. Further, $N_{3L}$ is preferably 0.5 times as fast as $N_{3M}$ of the rotational speed of the hydraulic motor 28 of the crusher 30. $N_{1L}$ and $N_{2L}$ are preferably 0.3 times as fast as $N_1$ and $N_2$ of the rotational speeds of the hydraulic motor 27 of the grizzly feeder 22 and the hydraulic motor 28 of the muck conveyor 26, respectively. In short, a deceleration rate of the grizzly feeder 22 and muck conveyor 26 on the upper stream of the crusher 30 is larger than a deceleration rate of the crusher 30. When a load applied on the crusher 30 is detected and the speeds of the grizzly feeder 22 and muck conveyor 26 are returned to their normal speeds from a state where no load is applied on the discharge conveyor 50 and the speeds of the grizzly feeder 22 and muck conveyor 26 are decelerated, the feed of the raw materials from the grizzly feeder 22 to the crusher 30 can be slowed down. Thus, even if the return of the speed of the crusher 30 to its normal speed is slower than other devices because of its inertia when the speeds of the grizzly feeder 22 and muck conveyor 26 are returned to their normal speeds, the raw materials can be fed to the crusher 30 after the crusher 30 is completely returned to its normal speed.

Next, the crusher pressure comparing unit 725 detects for a predetermined time a load pressure value $P_3$ of the crusher 30 to compare the load pressure value $P_3$ with the minimum pressure value $P_2$ stored in the memory 727 (S12). When the crusher pressure comparing unit 725 determines that the load pressure value $P_3$ is smaller than the minimum pressure value $P_2$, none of the raw materials are thrown into the crusher 30. Therefore, the flow rate controller 726 maintains the discharge flow rate Q of the hydraulic pumps 52 and 53 while maintaining the decelerated motor rotational speeds of the hydraulic motors 27 to 29, 35 and 55 of the grizzly feeder 22, muck conveyor 26, crusher 30, discharge conveyor 50 and magnetic separator 60 (S13). Then, the above-described steps S2, S3, S7 to S9 and S11 to S13 are repeated.

Conversely, when the crusher pressure comparing unit 725 determines that the load pressure value $P_3$ is larger than the minimum pressure value $P_2$ in S12, the raw materials are restarted to be thrown into the crusher 30. Therefore, the fuel injection quantity controller 711 outputs to the fuel injector a fuel injection signal of the engine speed ω set by the fuel dial 91 and drives the engine 49 with fuel injected based on the fuel injection signal. The flow rate controller 726 determines discharge flow rates of the hydraulic pumps 52 and 53 depending on the motor rotational speeds $N_1$, $N_2$, $N_3$, $N_4$ and $N_5$ that are set in advance and the set engine speed ω to control an angle (inclination angle) of the swash plates 52A and 53A (S1). Then, the above-described steps S2, S3, S7 to S9, S11 S12 and S1 are repeated. In other words, when the raw materials are thrown into the crusher 30, the motor rotational speeds of the hydraulic motors 27 to 29, 35 and 55 of the grizzly feeder 22, muck conveyor 26, crusher 30, discharge conveyor 50 and magnetic separator 60 are automatically increased. Thus, working efficiency for an operator can be enhanced.

When the work implement operating state determining unit 723 outputs the part-operation signal to the fuel injection quantity controller 711, the fuel injection quantity controller 711 controls a fuel injection quantity so that an amount of fuel corresponding to the engine speed set by the fuel dial 91 is injected to the engine 49. The flow rate controller 726 determines discharge flow rates of the hydraulic pumps 52 and 53 and controls an angle (inclination angle) of the swash plates 52A and 53A. Thus, the hydraulic motors 27 to 29, 35 and 55 are driven at the motor rotational speeds $N_1$, $N_2$, $N_3$, $N_4$ and $N_5$ for operation (S10). Then, the above-described steps S1 to S3, S7, S8 and S10 are repeated. Incidentally, when the work implement operating state is the part-operation state, one or two of the grizzly feeder 22, crusher 30 and discharge conveyor 50 are operated and therefore the mobile crusher is not operable for crushing. The above state in the operation mode may caused by stuck crushed materials. In order for restoration, the motor rotational speeds are controlled at the motor rotational speeds $N_1$, $N_2$, $N_3$, $N_4$ and $N_5$ for operation in S10.

Inspection Mode

Upon receiving the inspection-mode signal from the mode determining unit 721 in S3, the work implement operating state determining unit 723 determines operating states of the grizzly feeder 22, muck conveyor 26, crusher 30, discharge conveyor 50 and magnetic separator 60. When none of them are operated, the work implement operating state determining unit 723 outputs a non-operation signal to the fuel injection quantity controller 711. When at least one of the grizzly feeder 22, muck conveyor 26, crusher 30, discharge conveyor 50 and magnetic separator 60 is operated, the work implement operating state determining unit 723 outputs a part-operation signal to the fuel injection quantity controller 711 (S14).

Upon receiving the non-operation signal, the fuel injection quantity controller 711 reads a decelerated speed $\omega_0$ from the memory 713 to control a fuel injection quantity to be injected to the engine 49 depending on the decelerated speed $\omega_0$ (S6). Then, the above-described steps S2, S3 S14 and S6 are repeated. Upon receiving the part-operation signal, the fuel injection quantity controller 711 reads an engine speed set by the fuel dial 91 to supply of fuel of fuel injection quantity corresponding to the engine speed so as to drive the engine 49 (S5). Then, the above-described steps S1 to S3, S14 and S5 are repeated.

Since the load pressure value $P_1$ of the hydraulic motor 55 of the discharge conveyor 50 is initially detected by the conveyor pressure sensor 51 in the exemplary embodiment, it can be determined that the crushed materials are not fed on the discharge conveyor 50 when the load pressure value $P_1$ is smaller than the minimum pressure valve $P_0$. Accordingly, when the crushed materials are not fed on the discharge conveyor 50, it is determined that the raw materials or crushed materials are not present on any of the grizzly feeder 22, muck conveyor 26, crusher 30, discharge conveyor 50 and magnetic separator 60. Thus, the flow rate controller 726 controls the discharge flow of the hydraulic pumps 52 and 53 at Q to decelerate the motor rotational speeds of the hydraulic motors 27 to 29, 35 and 55 of the grizzly feeder 22, muck conveyor 26, crusher 30, discharge conveyor 50 and magnetic separator 60.

Then, the load pressure value $P_3$ of the hydraulic motor 35 of the crusher 30 is detected by the crusher pressure sensor 36 (raw material determining unit). When the load pressure value $P_3$ is larger than the minimum pressure valve $P_2$, it can be determined that the raw materials are present in the crusher 30. In other words, it can be reliably detected that the raw materials are thrown into the crusher 30. Accordingly, the engine 49 can be controlled to be driven with fuel having the fuel injection quantity set by the fuel dial 91. Also, the hydraulic motor rotational speeds of the grizzly feeder 22, muck conveyor 26, crusher 30, discharge conveyor 50 and magnetic separator 60 can be automatically controlled to be returned to the motor rotational speed ω for operation. Though the decelerated speed $\omega_0$ of the engine 49 and the normal speed ω are the same in this exemplary embodiment, fuel efficiency may be further enhanced when the decelerated speed $\omega_0$ is slower than the normal speed ω. When the engine speed is decelerated from the normal speed to the decelerated speed $\omega_0$, the discharge flow rates of the hydraulic pumps 52 and 53 are correspondingly reduced. Then, the motor rotational speeds of the hydraulic motors 27 to 29, 35 and 55 of the grizzly feeder 22, muck conveyor 26, crusher 30, discharge conveyor 50 and magnetic separator 60 are slowed down to $N_{1E}$, $N_{2E}$, $N_{3E}$, $N_{4E}$ and $N_{5E}$. According to an aspect of the invention, the discharge flow rates of the hydraulic pumps 52 and 53 and the rotational speeds of the hydraulic motors are further reduced from the above-described state.

The best arrangements, methods and the like for carrying out the invention are disclosed above, but the invention is not limited thereto. While the invention is particularly explained and illustrated mainly in relation to a specific embodiment, a person skilled in the art could make various modifications in terms of shape, amount or other particulars to the above-described embodiment without departing from the spirit and scope of the invention.

Therefore, because the above-disclosed description limiting the shape, amount and the like is merely an exemplified statement for facilitating understanding of the invention and is not a limitation on the invention, a statement using names of the members on which a part of or all of the limitations regarding the shape, amount and the like is eliminated is included in the invention.

For example, the crusher pressure sensor 36 detects a load pressure of the hydraulic motor 35 of the crusher 30 to detect whether the raw materials are thrown into the crusher 30 or not in the exemplary embodiment. However, whether the raw materials are thrown into the crusher 30 or not may be detected by detecting a rotational speed of the hydraulic motor 35 of the crusher 30. Since the rotational speed of the hydraulic motor 35 is varied depending on the presence or absence of the raw materials, whether the raw materials are thrown into the crusher 30 or not can be detected by detecting the variation of the rotational speed.

Though the conveyor pressure sensor 51 is used as the crushed material determining unit in the exemplary embodiment, a strain gauge may be alternatively used on a bracket that supports carrier rollers of the discharge conveyor 50.

Though the flow rate controller 726 controls the discharge flow rates of the hydraulic pumps 52 and 53 in the exemplary embodiment, the hydraulic motors 27 to 29, 35 and 55 driven by the hydraulic pumps 52 and 53 may be set variable to control the motor rotational speeds. Alternatively, only pilot pressures of the control valves 112 to 116 may be controlled to be electromagnetically proportional to control the flow rates of hydraulic oil supplied to the hydraulic motors 27 to 29, 35 and 55.

Though the pressure sensor 36 is used for measuring a load pressure of the hydraulic motor 35 of the crusher 30 as the raw material determining unit in the exemplary embodiment, a rotation sensor may be alternatively used for measuring a motor rotational speed of the hydraulic motor 35 of the crusher 30.

Further, though the motors 27 to 29, 35 and 55 for driving the grizzly feeder 22, muck conveyor 26, crusher 30, discharge conveyor 50 and magnetic separator 60 are hydraulically driven in the exemplary embodiment, the motors may be electrically driven.

Though the auto deceleration control is executed depending on the presence or absence of the grizzly feeder 22, muck conveyor 26, crusher 30, discharge conveyor 50 and magnetic separator 60 in the exemplary embodiment, the auto deceleration control may be executed by determining a load applied on the crusher 30 by the raw material determining unit. Alternatively, the auto deceleration control may be executed by determining a load applied on the discharge conveyor 50 by the crushed material determining unit.

The entire disclosure of Japanese Patent Application No. 2008-139467, filed May 28, 2008, and No. 2009-078912, filed Mar. 27, 2009, are expressly incorporated by reference herein.

What is claimed is:

1. A mobile crusher comprising:

a crusher that crushes raw materials;

a discharge conveyor provided downstream of the crusher to discharge the crushed materials crushed by the crusher;

a work implement provided upstream of the crusher;

a crushed material determining unit that determines whether the crushed materials to be discharged are present or absent on the discharge conveyor;

a raw material determining unit that determines whether the raw materials are present or absent in the crusher; and a work implement speed controller that controls speeds of the crusher, the discharge conveyor, and the work implement, based on determination results of the crushed material determining unit and the raw material determining unit.

2. The mobile crusher according to claim 1, further comprising:

hydraulic motors that drive the crusher, the discharge conveyor, and the work implement, respectively; and a hydraulic pump that supplies hydraulic oil to the hydraulic motors, wherein the work implement speed controller controls a discharge flow rate of the hydraulic pump.

3. The mobile crusher according to claim 2, further comprising:

a control valve that controls a flow rate of the hydraulic oil supplied from the hydraulic pump to the hydraulic motors, wherein the work implement speed controller further controls an amount of the hydraulic oil supplied to the hydraulic motors by the control valve so as to control rotational speeds of the hydraulic motors.

4. The mobile crusher according to claim 1, wherein the work implement speed controller decelerates respective rotational speeds of hydraulic motors of the crusher, the discharge conveyor, and the work implement, from rotational speeds for operation to decelerated rotational speeds when the crushed material determining unit determines that the crushed materials are not present on the discharge conveyor, and wherein the work implement speed controller accelerates the rotational speeds of the hydraulic motors to the rotational speeds for operation when the raw material determining unit determines that the raw materials are present in the crusher while the rotational speeds of the hydraulic motors are the decelerated rotational speeds.

5. The mobile crusher according to claim 1, wherein the crushed material determining unit includes a pressure sensor that measures a load pressure of a hydraulic motor of the discharge conveyor.

6. The mobile crusher according to claim 1, wherein the raw material determining unit includes a pressure sensor that measures a load pressure of a hydraulic motor of the crusher.

7. The mobile crusher according to claim 1, further comprising:

hydraulic motors that drive the crusher, the discharge conveyor, and the work implement, respectively;

a hydraulic pump that supplies hydraulic oil to the hydraulic motors and drives the hydraulic motors, wherein the work implement speed controller controls the speeds of the crusher, the discharge conveyor, and the work implement, by controlling a discharge flow rate of the hydraulic pump.

8. The mobile crusher according to claim 7, wherein the speeds of the crusher, the discharge conveyor, and the work implement are rotational speeds of the hydraulic motors, respectively.

9. The mobile crusher according to claim 1, wherein the crushed material determining unit includes a pressure sensor that measures a load pressure of a hydraulic motor of the discharge conveyor and determines that the crushed materials to be discharged are not present on the discharge conveyor when the load pressure is equal to or less than a predetermined pressure for a predetermined time, the predetermined time being longer than a series of operation times for crushing the raw materials in the crusher and discharging the crushed materials from the discharge conveyor.

10. The mobile crusher according to claim 1, wherein the work implement speed controller decelerates the speeds of the crusher, the discharge conveyor, and the work implement when the crushed material determining unit determines that the crushed materials are not present on the discharge conveyor.

11. The mobile crusher according to claim 10, wherein the work implement speed controller decelerates the speeds of the crusher, the discharge conveyor, and the work implement so that a deceleration rate of the work implement is larger than a deceleration rate of the crusher.

12. A mobile crusher comprising:

a crusher that crushes raw materials;

a discharge conveyor provided downstream of the crusher to discharge the crushed materials crushed by the crusher;

a work implement provided upstream of the crusher;

an engine that drives the crusher, the discharge conveyor, and the work implement;

an engine controller that decelerates an engine speed to a decelerated speed when it is that no load is applied on the crusher;

hydraulic motors that drive the crusher, the discharge conveyor, and the work implement, respectively;

a hydraulic pump driven by the engine to supply hydraulic oil to the hydraulic motors and drive the hydraulic motors; and a work implement speed controller that controls speeds of the crusher, the discharge conveyor, and the work implement, to reduce a discharge flow rate of the hydraulic pump and decelerate rotational speeds of the hydraulic motors so that a deceleration rate of the work implement is larger than a deceleration rate of the crusher when the engine controller decelerates the engine speed to the decelerated speed.

13. The mobile crusher according to claim 12, wherein the work implement is a feeder that feeds the raw materials to the crusher.

* * * * *